US005471687A

United States Patent [19]

Vierra

[11] Patent Number: 5,471,687

[45] Date of Patent: Dec. 5, 1995

[54] AIR MATTRESS SLEEPING BAG

[76] Inventor: Michael J. Vierra, R.R. 2 Box 108, Kula, Hi. 96790

[21] Appl. No.: 384,023

[22] Filed: Feb. 6, 1995

[51] Int. Cl.[6] ..... A47G 9/08

[52] U.S. Cl. ..... 5/413; 5/455; 5/922

[58] Field of Search ..... 5/413, 419, 455, 5/449, 922; 2/69.5

[56] References Cited

U.S. PATENT DOCUMENTS

| | | | |
|---|---|---|---|
| 867,464 | 10/1907 | Abbott | 5/413 |
| 1,324,009 | 12/1919 | Hope | 5/413 |
| 3,798,686 | 3/1974 | Gaiser | 5/413 |
| 4,092,750 | 6/1978 | Ellis | 5/413 |
| 5,005,236 | 4/1991 | Hutchinson | 5/413 |

FOREIGN PATENT DOCUMENTS

| | | | |
|---|---|---|---|
| 2516781 | 10/1976 | Germany | 5/413 |
| 648452 | 1/1951 | United Kingdom | 5/413 |
| 979852 | 1/1965 | United Kingdom | 5/413 |

*Primary Examiner*—Alexander Grosz

[57] ABSTRACT

A sleeping bag for insulating and comfortably supporting an individual relative to a ground surface. The inventive device includes a sleeping bag assembly for receiving and insulating an individual. A pneumatic support assembly is coupled to a bottom of the sleeping bag assembly for supporting the sleeping bag assembly and an associated individual in a spaced relationship relative to a rough or uneven terrain.

7 Claims, 4 Drawing Sheets

AIR MATTRESS SLEEPING BAG

BACKGROUND OF THE INVENTION

1. Field of the Invention

The present invention relates to portable bedding devices and more particularly pertains to an air mattress sleeping bag for insulating and comfortably supporting an individual relative to a ground surface.

2. Description of the Prior Art

The use of portable bedding devices is known in the prior art. More specifically, portable bedding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art portable bedding devices include U.S. Pat. No. 4,996,733; U.S. Pat. No. 4,862,533; U.S. Pat. No. 4,575,884; U.S. Pat. No. 3,877,092; and U.S. Pat. No. 3,798,686.

While these devices fulfill their respective, particular objectives and requirements, the aforementioned patents do not disclose an air mattress sleeping bag for insulating and comfortably supporting an individual relative to a ground surface which includes a sleeping bag assembly for receiving and insulating an individual, and a pneumatic support assembly coupled to a bottom of the sleeping bag assembly for supporting the sleeping bag assembly and associated individual in a spaced relationship relative to rough or uneven terrain.

In these respects, the air mattress sleeping bag according to the present invention substantially departs from the conventional concepts and designs of the prior art, and in so doing provides an apparatus primarily developed for the purpose of insulating and supporting an individual relative to a ground surface.

SUMMARY OF THE INVENTION

In view of the foregoing disadvantages inherent in the known types of portable bedding devices now present in the prior art, the present invention provides a new air mattress sleeping bag construction wherein the same can be utilized for comfortably insulating and supporting an individual relative to a ground surface. As such, the general purpose of the present invention, which will be described subsequently in greater detail, is to provide a new air mattress sleeping bag apparatus and method which has many of the advantages of the portable bedding devices mentioned heretofore and many novel features that result in a air mattress sleeping bag which is not anticipated, rendered obvious, suggested, or even implied by any of the prior art portable bedding devices, either alone or in any combination thereof.

To attain this, the present invention generally comprises sleeping bag for insulating and comfortably supporting an individual relative to a ground surface. The inventive device includes a sleeping bag assembly for receiving and insulating an individual. A pneumatic support assembly is coupled to a bottom of the sleeping bag assembly for supporting the sleeping bag assembly and an associated individual in a spaced relationship relative to a rough or uneven terrain.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new air mattress sleeping bag apparatus and method which has many of the advantages of the portable bedding devices mentioned heretofore and many novel features that result in a air mattress sleeping bag which is not anticipated, rendered obvious, suggested, or even implied by any of the prior art portable bedding devices, either alone or in any combination thereof.

It is another object of the present invention to provide a new air mattress sleeping bag which may be easily and efficiently manufactured and marketed.

It is a further object of the present invention to provide a new air mattress sleeping bag which is of a durable and reliable construction.

An even further object of the present invention is to provide a new air mattress sleeping bag which is susceptible of a low cost of manufacture with regard to both materials and labor, and which accordingly is then susceptible of low prices of sale to the consuming public, thereby making such air mattress sleeping bags economically available to the buying public.

Still yet another object of the present invention is to provide a new air mattress sleeping bag which provides in the apparatuses and methods of the prior art some of the advantages thereof, while simultaneously overcoming some of the disadvantages normally associated therewith.

Still another object of the present invention is to provide a new air mattress sleeping bag for insulating and comfortably supporting an individual relative to a ground surface.

Yet another object of the present invention is to provide a new air mattress sleeping bag which includes a sleeping bag assembly for receiving and insulating an individual, and a pneumatic support assembly coupled to a bottom of the sleeping bag assembly for supporting the sleeping bag assembly and associated individual in a spaced relationship relative to rough or uneven terrain.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
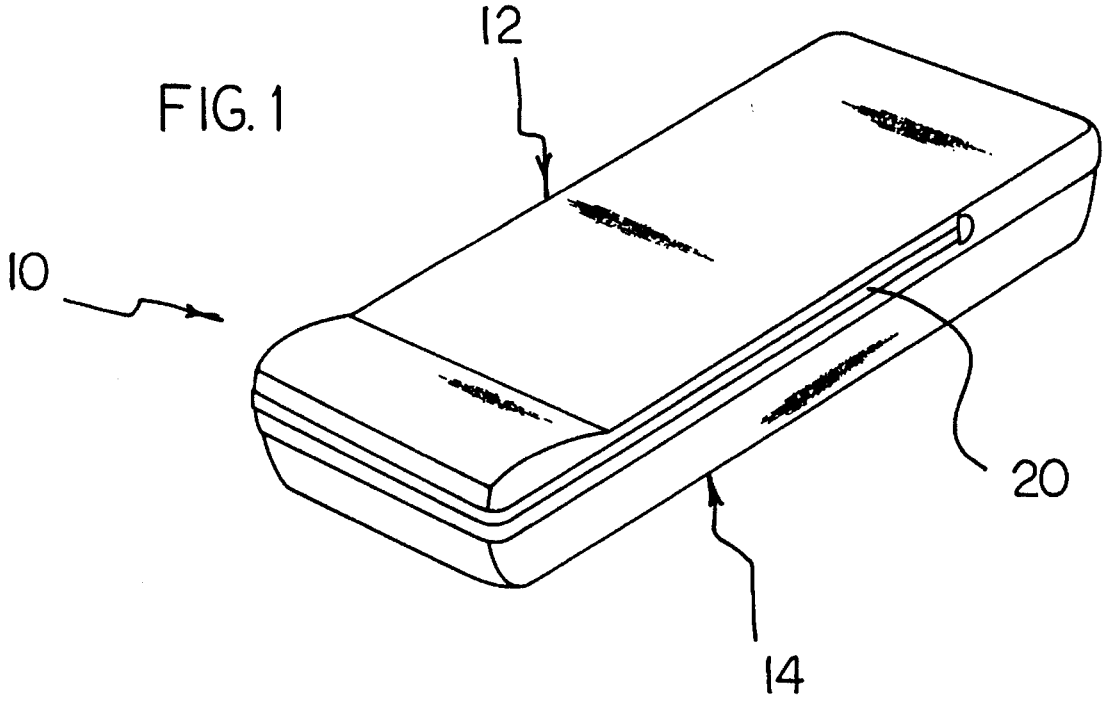
FIG. 1 is an isometric illustration of a air mattress sleeping bag according to the present invention.

With reference now to the drawings, and in particular to FIGS. 1–8 thereof, a new air mattress sleeping bag embodying the principles and concepts of the present invention and generally designated by the reference numeral 10 will be described.

More specifically, it will be noted that the air mattress sleeping bag 10 comprises a sleeping bag means 12 for receiving and insulating an individual positioned therewithin. A pneumatic support means 14 is coupled to a lower portion of the sleeping bag means 12 for supporting the sleeping bag means and an associated individual positioned therewithin in a spaced relationship relative to a ground surface therebeneath. By this structure, an individual can be comfortably supported in a spaced relationship relative to rough or uneven terrain.

Figure 2:
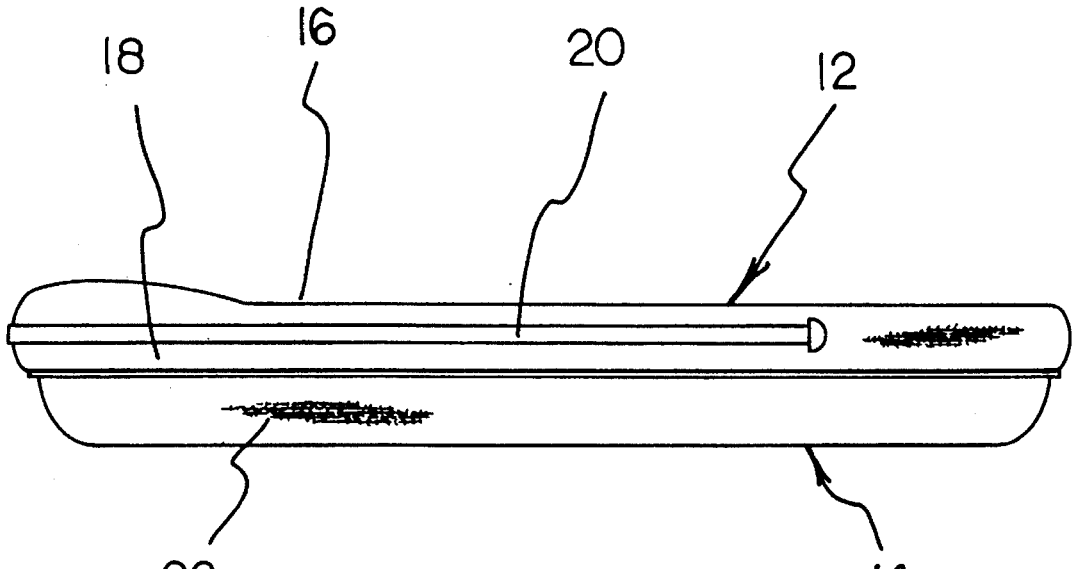
FIG. 2 is a side elevation view thereof.
Figure 3:
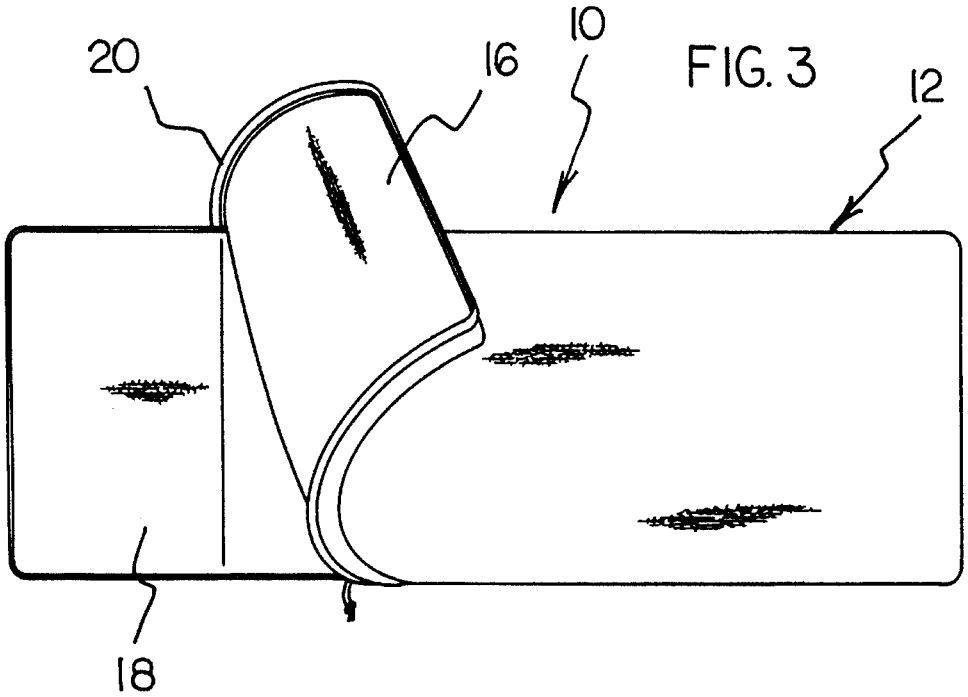
FIG. 3 is a top plan view of the present invention in an open configuration.
Figure 4:
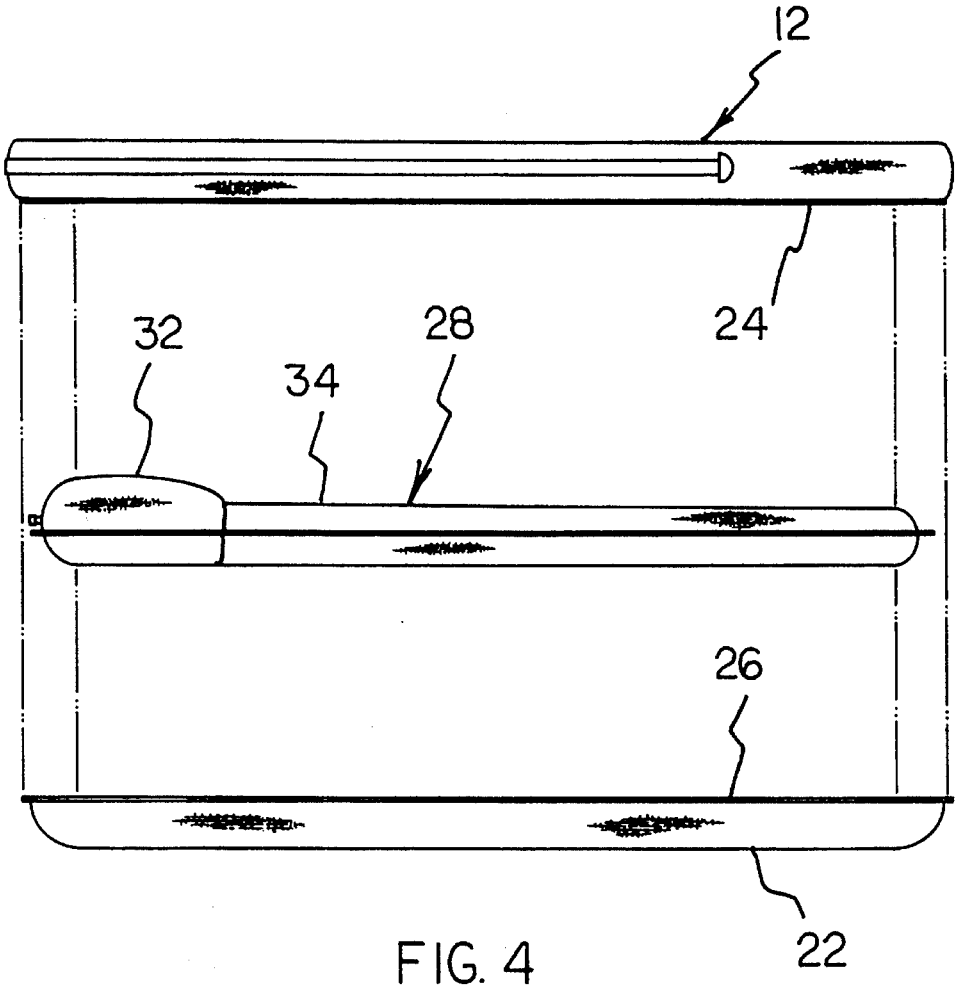
FIG. 4 is an exploded side elevation view of the invention.

As best illustrated in FIGS. 2 and 3, it can be shown that the sleeping bag means 12 according to the present invention 10 preferably comprises an upper insulated web 16 and a lower insulated web 18. The upper insulated web 16 is coupled along a periphery thereof to a periphery of the lower insulated web 18. Preferably, a covered zipper 20 extends between the upper insulated web 16 and the lower insulated web 18 to permit selective coupling of a desired portion of the peripheries of the webs 16 and 18 together. By this structure, an individual can be positioned between the insulated webs 16 and 18 to provide coverage and insulation of such individual during sleep.

Figure 5:
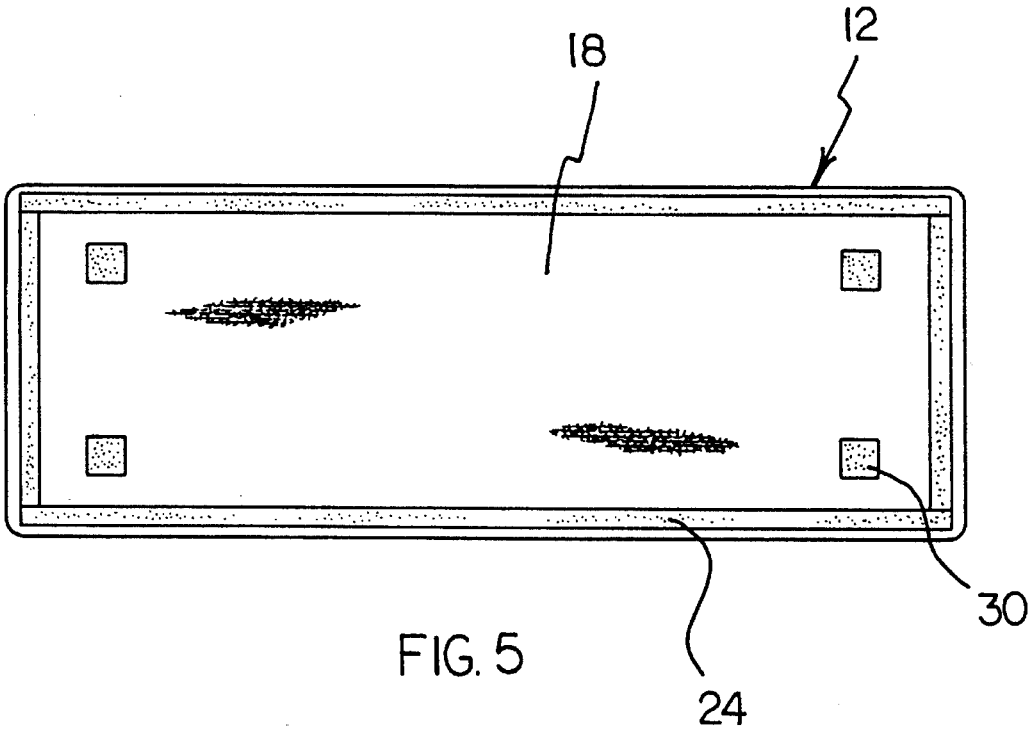
FIG. 5 is a bottom plan view of a sleeping bag means comprising a portion of the present invention.
Figure 6:
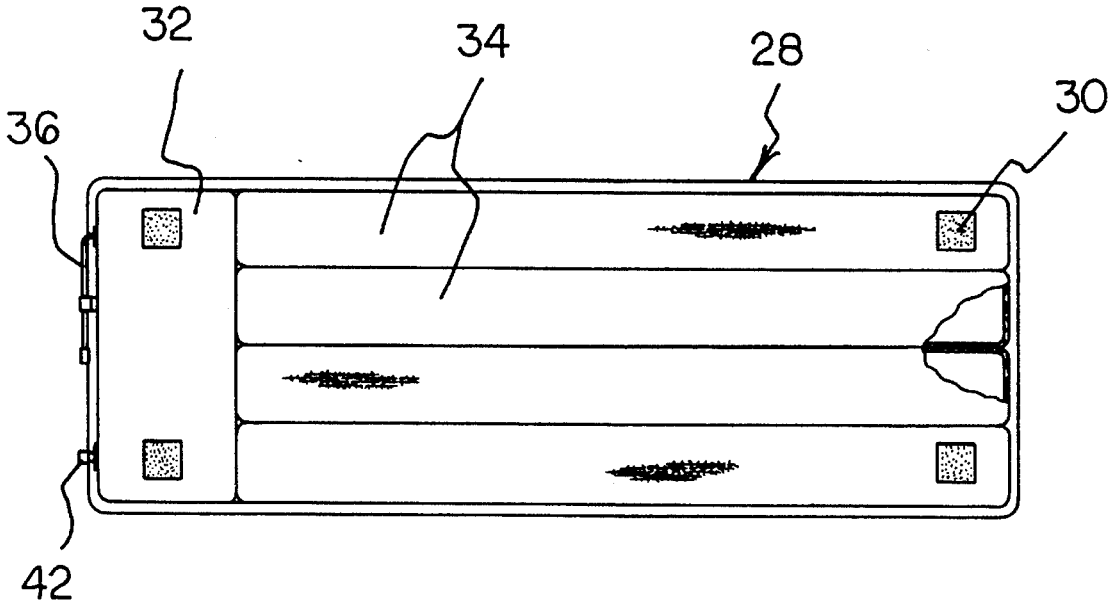
FIG. 6 is a top plan view of an air mattress comprising a portion of the present invention.

Referring now to FIGS. 4 through 8, it can be shown that the pneumatic support means 14 according to the present invention 10 preferably comprises a lower envelope 22 removably coupled to a bottom surface of the lower insulated web 18 of the sleeping bag means 12. To this end, a first portion of a fabric fastener strip 24 extends along a portion of the bottom surface of the lower insulated web 18 and cooperates with a second portion of a fabric fastener strip 26 secured to the lower envelope 22. By this structure, an air mattress 28 can be removably positioned between the bottom surface of the lower insulated web 18 of the sleeping bag means 12 and the lower envelope 22 so as to be captured within the lower envelope. To further secure the air mattress 28 relative to the lower insulated web 18 of the sleeping bag means 12, a plurality of fabric fastener patches 30 of cooperating configuration are preferably coupled to an upper surface of the air mattress 28 and to the bottom surface of the lower insulated web 18, as shown in FIGS. 5 and 6 of the drawings.

Figure 7:
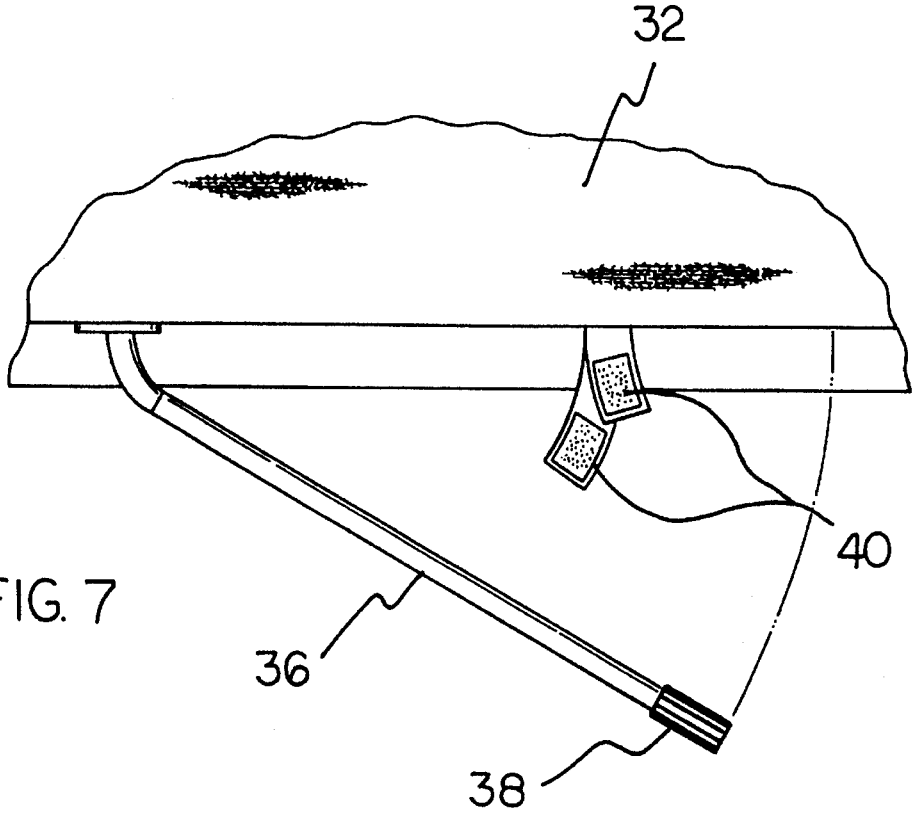
FIG. 7 is an enlarged top plan view of a portion of the present invention.
Figure 8:
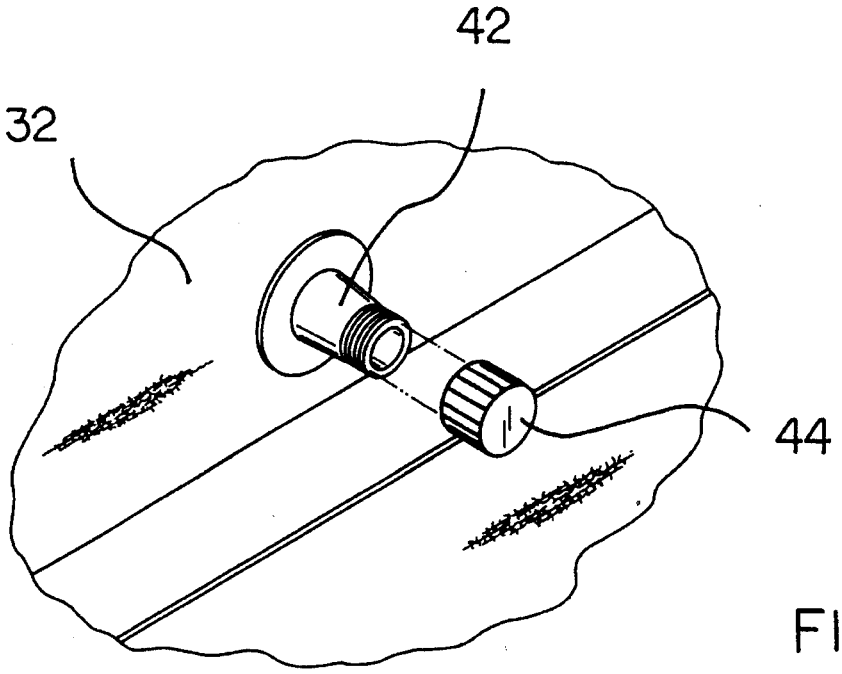
FIG. 8 is an enlarged isometric illustration of a further portion of the present invention.

As shown in FIGS. 6 through 8, the air mattress 28 according to the present invention 10 preferably comprises a substantially rectangular pillow chamber 32 and a plurality of elongated pneumatic chambers 34. The elongated pneumatic chambers 34 are positioned in a side-by-side relationship and extend substantially orthogonally from the pillow chamber 32. Thus, the elongated pneumatic chambers 34 cooperate with the pillow chamber 32 to define a substantially rectangular shape of the air mattress 28. Further, the pillow chamber 32 is in fluid communication with each of the elongated pneumatic chambers 34 such that an inflation of the pillow chamber will effect concurrent inflation of the elongated pneumatic chambers as desired. To this end, and as best shown in FIGS. 7 and 8, an elongated inflation tube 36 is pivotally and rotatably coupled to the pillow chamber 32 and can be selectively utilized to inject pressurized air, i.e. such as air directed from a mouth of an individual, into the pillow chamber 32 to inflate the air mattress 28. A one-way check valve 38 is secured to an end of the elongated inflation tube 36 permits a one-way direction of air into the air mattress 28 to preclude an egress of pressurized air from the air mattress between breathes of an individual inflating the device 10. A pair of securing straps 40 coupled to a portion of the air mattress 28, preferably coupled to the pillow chamber 32, can be selectively coupled together to store the elongated inflation tube 36 adjacent to the pillow chamber 32. As shown in FIG. 8 a drain tube 42 extends into fluid communication with the pillow chamber 32 and includes a removable cap 44 permitting drainage of water and/or fluids from the air mattress 28. By this structure, the air mattress 28 can be selectively inflated through manual exhalation means and subsequently deflated as desired.

In use, the air mattress sleeping bag 10 according to the present invention can be easily utilized for insulating and comfortably supporting an individual relative to a ground surface. The air mattress 28 of the pneumatic support means 14 can be selectively inflated to a desired stiffness according to the desires of the individual inflating the device 10. The sleeping bag 10 can be conveniently stored in a deflated and folded condition for traveling and/or storage purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A air mattress sleeping bag comprising:

a sleeping bag means for receiving and insulating an individual positionable therewithin;

a pneumatic support means coupled to a lower portion of the sleeping bag means for supporting the sleeping bag means and an associated individual positionable therewithin in a spaced relationship relative to a ground surface therebeneath, the sleeping bag means comprising an upper insulated web being coupled along a portion of a periphery thereof to a portion of a periphery of a lower insulated web, and a zipper extending between the upper insulated web and the lower insulated web to permit selective coupling of a desired portion of the peripheries of the webs together, the pneumatic support means comprising a lower envelope removably coupled to a bottom surface of the lower insulated web of the sleeping bag means; and an air mattress removably positioned between the bottom surface of the lower insulated web of the sleeping bag means and the lower envelope so as to be captured within the lower envelope, a first portion of a fabric fastener strip extending along a portion of the bottom surface of the lower insulated web and cooperating with the a second portion of a fabric fastener strip secured to the lower envelope to secure the lower envelope to the lower insulated web, and a plurality of fabric fastener patches coupled to an upper surface of the air mattress and to the bottom surface of the lower insulated web to secure the air mattress relative to the lower insulated web of the sleeping bag means.

2. The air mattress sleeping bag of claim 1, wherein the air mattress comprises a substantially rectangular pillow chamber and a plurality of elongated pneumatic chambers coupled to the pillow chamber, the elongated pneumatic chambers being positioned in a side-by-side relationship and extending substantially orthogonally from the pillow chamber.

3. The air mattress sleeping bag of claim 2, wherein the elongated pneumatic chambers cooperate with the pillow chamber to define a substantially rectangular shape of the air mattress.

4. The air mattress sleeping bag of claim 3, wherein the pillow chamber is positioned in fluid communication with each of the elongated pneumatic chambers such that an inflation of the pillow chamber will effect concurrent inflation of the elongated pneumatic chambers.

5. The air mattress sleeping bag of claim 4, and further comprising an elongated inflation tube pivotally and rotatably coupled to the pillow chamber which can be selectively utilized to inject pressurized air into the pillow chamber to inflate the air mattress, and a one-way check valve secured to an end of the elongated inflation tube for permitting a one-way direction of air into the air mattress to preclude an egress of pressurized air from the air mattress through the inflation tube.

6. The air mattress sleeping bag of claim 5, and further comprising a pair of securing straps coupled to a portion of the air mattress which can be selectively coupled together to store the elongated inflation tube adjacent to the pillow chamber.

7. The air mattress sleeping bag of claim 6, and further comprising a drain tube extending into fluid communication with the pillow chamber, and a removable cap positioned within the draining tube and removable therefrom to permit drainage of fluid from the air mattress.

* * * * *